United States Patent [19]

Adams

[11] Patent Number: 4,498,272

[45] Date of Patent: Feb. 12, 1985

[54] PANEL FASTENER

[75] Inventor: George C. Adams, Ann Arbor, Mich.

[73] Assignee: Rollform, Incorporated, Ann Arbor, Mich.

[21] Appl. No.: 380,211

[22] Filed: May 20, 1982

[51] Int. Cl.[3] ..... E04B 1/60; E04B 2/72

[52] U.S. Cl. ..... 52/714; 52/363; 52/483; 52/509

[58] Field of Search ..... 52/361, 363, 483, 489, 52/509, 512, 714, DIG. 6

[56] References Cited

U.S. PATENT DOCUMENTS

| | | | |
|---|---|---|---|
| 2,174,145 | 9/1939 | Tummins | 52/509 X |
| 2,281,519 | 4/1942 | Faber | 52/509 X |
| 2,314,638 | 3/1943 | Tummins | 52/363 X |
| 2,326,506 | 8/1943 | Tummins | 52/363 X |
| 4,333,286 | 6/1982 | Weinar | 52/489 X |
| 4,448,007 | 5/1984 | Adams | 52/714 X |

*Primary Examiner*—Alfred C. Perham

*Attorney, Agent, or Firm*—Gifford, VanOphem, Sheridan, Sprinkle & Nabozny

[57] ABSTRACT

An improved panel or wallboard fastener for securing a panel to a framing member. The wallboard fastener comprises a substantially planar base having a single impaling flange secured to it at a midpoint. The impaling flange includes a first leg which extends substantially perpendicularly outwardly from the base and a second leg secured to the first leg and which lies in a plane substantially parallel to but spaced from the base. The second leg of the impaling flange forms a point which is insertable into an edge of the panel, typically a sheet of wallboard.

7 Claims, 6 Drawing Figures

PANEL FASTENER

BACKGROUND OF THE INVENTION

I. Field of the Invention

The present invention relates to a fastener for securing a panel, such as a sheet of wallboard, to a framing member.

II. Description of the Prior Art

There are a number of previously known panel or wallboard fasteners which are used to secure panels, such as sheets of wallboard, to framing members. These previously known devices typically comprise a base portion which is insertable behind the wallboard sheet and a pair of spaced impaling flanges which are insertable into one edge of the wallboard sheet. After insertion, a tongue protrudes outwardly from the edge of the wallboard sheet and this tongue is secured to the framing member in any conventional fashion, such as a screw or nail.

It is the common practice with these previously known wallboard fasteners to use a hammer to drive the impaling flanges into the edge of the wallboard sheet. After the wallboard fastener is secured to the wallboard sheet, the fastener is then secured to the framing member.

One disadvantage with these previously known wallboard fasteners is that only one impaling flange can be hammered into the edge of the wallboard sheet at a single time. Moreover, unless the impaling flange is struck squarely with a hammer, the other impaling flange will pull out somewhat from the wallboard edge and must be rehammered back into the edge of the wallboard. Frequently, it is necessary to repeatedly hammer both impaling flanges into the edge of the wallboard sheet until both flanges are flush against the edge of the wallboard sheet. This process is time consuming, results in higher labor costs and frequently results in damage to the wallboard sheet.

Distortions occur in heat treat which tilt paired impaling flanges in opposed angles from a flat plane. This can cause some twisting of the clip.

SUMMARY OF THE PRESENT INVENTION

The present invention provides a panel or wallboard fastener which overcomes the above mentioned disadvantages of the previously known fasteners.

In brief, the fastener according to the present invention comprises a substantially planar base having a single impaling flange secured to a midpoint of the base. The flange includes a first leg which extends substantially perpendicularly outwardly from the base and a second leg which lies in a plane substantially parallel to but spaced from the base and having a point formed on it. This point is adapted to be driven into the edge of a panel, such as a wallboard sheet. With the base driven into the edge of the sheet, the base is secured to a framing member in any conventional means, such as by screwing.

Since the fastener of the present invention comprises only a single impaling flange, the previously noted necessity of driving two spaced impaling flanges into the edge of the wallboard sheet until both flanges are flush against the sheet edge is entirely eliminated.

Further, with the single impaling flange of this design being in line with the longitudinal axis of the fastener it can be easily driven straight and true with a minimum of effort on the part of the mechanic.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
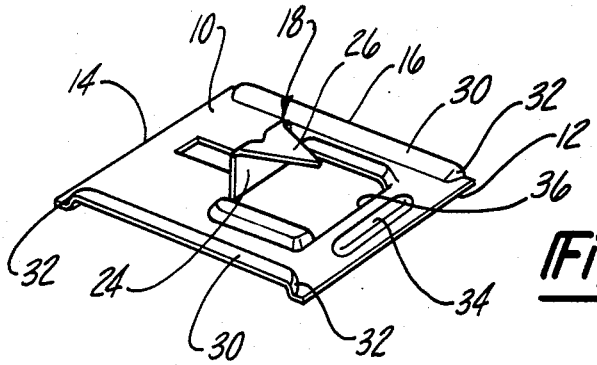
FIG. 1 is a perspective view illustrating a preferred embodiment of the fastener of the present invention.
Figure 5:
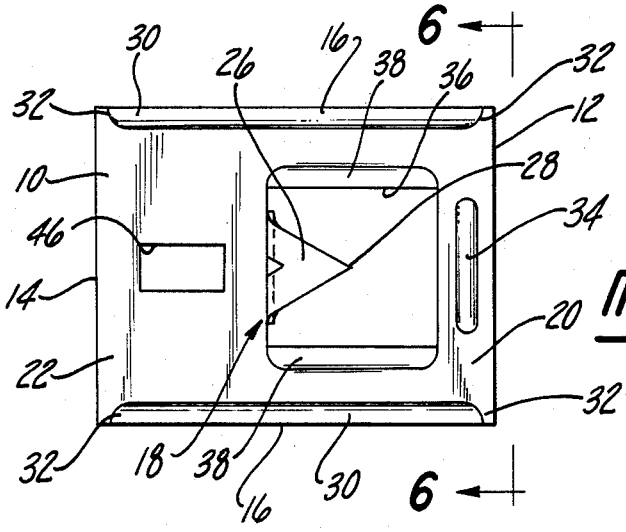
FIG. 5 is a top plan view of the preferred embodiment of the fastener of the present invention.
Figure 6:
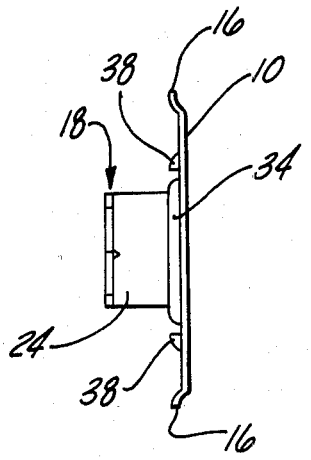
FIG. 6 is an end view taken substantially along lines 6—6 in FIG. 5.

With reference first to FIGS. 1, 5 and 6, a preferred embodiment of the panel fastener of the present invention is thereshown and comprises a generally planar base 10. The base 10 is preferably rectangular in cross sectional shape thus having a first end 12, a second end 14 and sides 16. The sides 16 are substantially parallel to each other and, similarly, the ends 12 and 14 are also substantially parallel to each other.

A single impaling flange 18 is formed at a midpoint of the base 10. The impaling flange 18 is spaced inwardly from both ends 12 and 14 of the base and is preferably equidistantly spaced inwardly from the sides 16 of the base 10. The impaling flange 18 thus divides the base 10 into a first portion 20 between the flange 18 and the base end 12, and a second portion 22 between the flange 18 and the other base end 14.

Still referring to FIGS. 1, 5 and 6, the impaling flange 18 comprises a first leg 24 which extends outwardly from the base 10 so that the leg 24 lies in a plane substantially perpendicular to the plane of the base 10. This flange leg 24 is also substantially parallel to the ends 12 and 14 of the base 10 and thus perpendicular to the sides 16 of the base 10. A second leg 26 of the impaling flange 18 is substantially perpendicular to the first leg 24 so that the second leg 26 lies in a plane substantially parallel to but spaced from the base 10. This second flange leg 26 formed into a point 28, as best shown in FIG. 5, which faces but terminates short of the end 12 of the base 10.

With reference now particularly to FIGS. 1 and 5, a ridge 30 is formed along each side 16 of the base 10. Each ridge 30 terminates short of the ends 12 and 14 thus forming a sloped portion 32 at each end of each ridge 30 for a reason to be subsequently described. Similarly, a transverse ridge 34 is formed parallel to and closely adjacent the end 12 of the base 10. Both the side ridges 30 and transverse ridge 34 protrude outwardly from the base 10 in the same direction as the impaling flange 18 and the purpose of the ridges 30 and 34 will be subsequently described.

The fastener according to the present invention preferably comprises a stamping and is of a one-piece construction. An opening 36 is formed in the base portion 20 so that one end of the opening 36 is aligned with the first leg 24 of the impaling flange 18. This opening 36 is formed during the stamping process to provide material for the impaling flange 18. In addition, upwardly extending humps 38 are formed on both sides of the opening 36 and, as best shown in FIG. 6, the humps 38, ridges 30 and transverse ridge 34 all protrude outwardly from the base 10 by substantially the same amount. A rectangular hole 46 is also formed in the base portion 22 during the stamping process.

Figure 2:
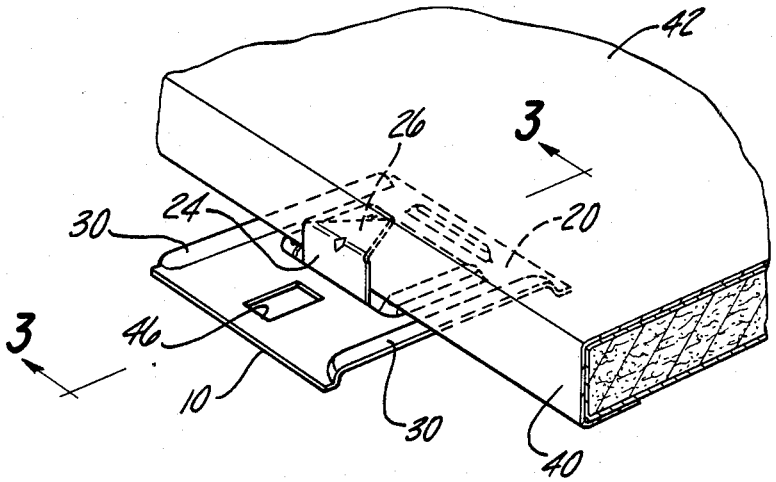
FIG. 2 is a perspective view of the preferred embodiment of the present invention and illustrating the installation of the fastener into a panel.
Figure 3:
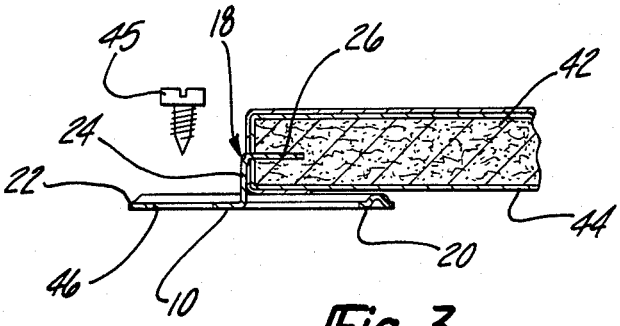
FIG. 3 is a sectional view taken substanially along line 3—3 in FIG. 2.

With reference now particularly to FIGS. 2 and 3, the fastener of the present invention is thereshown secured in one edge 40 of a panel 42, such as a sheet of wallboard. With the fastener attached to the panel 42, the base portion 20 is positioned behind the rear side 44 of the panel 42 and the pointed leg 26 of the impaling flange 18 is driven into the panel edge 40 by any conventional means, such as by hammering. Furthermore, the impaling flange 18 is driven into the panel edge 40 until the first leg 24 is substantially flush against the panel edge 40 as best shown in FIG. 3.

After installation of the fastener in the panel edge 40 as described above, the base portion 22 protrudes outwardly from the panel edge 40 as shown in FIGS. 2 and 3. Simultaneously, the side ridges 30, the transverse ridge 34 and the humps 38 space the rear side 44 of the panel 42 upwardly from the base 10 as best shown in FIG. 3.

Figure 4:
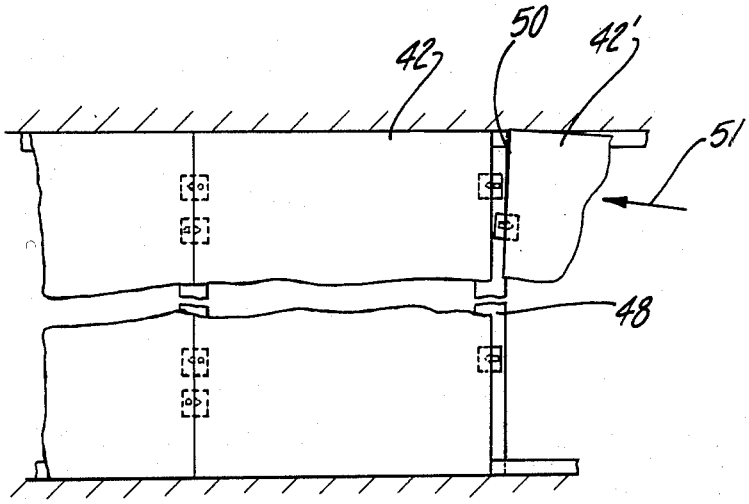
FIG. 4 is a fragmentary view illustrating the construction of a wall utilizing the fastener of the present invention.

With reference now to FIG. 4, after installation of at least one, and preferably two or more fasteners along one edge 40 of the panel 42, the fasteners with their attached panels 42 are secured to wall framing members 48 by nails, screws or the like 45 (FIG. 3) extending through the fastener opening 46 and into the framing member 48. The elongated rectangular hole 46 provides some lateral adjustment of the panel 42 relative to the framing members 48.

After one panel 42 has been secured to the wall framing members 48 as described above, a further panel 42' having fasteners secured along its edge 50 is slid along the wall in the direction of arrow 51 until the adjacent edges of the panel 42 and 42' abut against each other. With these edges abutting against each other, the base portions 22 of the fasteners secured to the edge 50 of the further panel 42' are positioned behind the rear surface 44 of the first panel 42 and thus hold the panels 42 and 42' together. The sloped portions 32 on the ridges 30 facilitates the insertion of the base portions 20 and 22 behind the rear sides 44 of the panels 42 and 42' during the construction of the wall. The opposite end (not shown) of the further panel 42' is then secured to the next framing member (not shown) and the above described process is repeated.

The ridges 30 and 34 as well as the humps 38 also serve to recess the head of the screw 45 from the rear side 44 of the panel 42.

From the foregoing, it can be seen that the panel fastener according to the present invention provides a simple, inexpensive and yet totally effective panel fastener for constructing walls. Furthermore, since the fastener of the present invention utilizes only a single impaling flange, the impaling flange 18 can be rapidly and easily secured to the panel edge 40. The use of a single impaling flange is also less expensive to manufacture than the previously known devices.

Having described my invention, however, many modifications thereto will become apparent to those skilled in the art to which it pertains without deviation from the spirit of the invention as descibed by the scope of the appended claims.

I claim:

1. A wallboard fastener adapted for securing a panel to a framing member comprising:

a substantially planar base having two spaced ends and two spaced longitudinally extending edges, a single impaling flange secured to a midpoint of said base, said impaling flange comprising a first leg extending perpendicularly outwardly from said base and a second leg extending from the free end of said leg in a plane parallel to but spaced from said base, said second leg forming at least one point which faces one end of said base and which is adapted for insertion into one edge of said panel, a ridge formed along each of said longitudinally extending edges of said base, said ridges being formed by bending said edges outwardly from said base in the same direction as said impaling flange, and said base including a fastener opening positioned between said ridges and between said impaling flange and the other end of said base.

2. The invention as defined in claim 1 wherein said impaling flange is substantially equidistantly spaced inwardly from said longitudinally extending edges of said base.

3. The invention as defined in claim 1 and comprising a transverse ridge formed on said base, said transverse ridge being substantially parallel to but spaced inwardly from said one end of said base and protruding outwardly in the same direction from said base as said impaling flange.

4. The invention as defined in claim 1 wherein said fastener is of a one-piece construction.

5. The invention as defined in claim 4 wherein said fastener comprises a stamping, said impaling flange being formed from a portion of said base between said impaling flange and said one end of said base.

6. The invention as defined in claim 5 wherein said base includes a further opening having one end adjacent said impaling flange and its other end spaced inwardly from said one end of said base, said second leg of said impaling flange being positioned over said further opening, and further comprising humps on opposite sides of said further opening which protrude outwardly from said base in the same direction as said impaling flange.

7. The invention as defined in claim 1 wherein each end of each ridge terminates in a portion which slopes outwardly toward its adjacent end of said base.

* * * * *

UNITED STATES PATENT AND TRADEMARK OFFICE

CERTIFICATE OF CORRECTION

PATENT NO. : 4,498,272

DATED : February 12, 1985

INVENTOR(S) : George Adams

It is certified that error appears in the above—identified patent and that said Letters Patent is hereby corrected as shown below:

Column 4, line 59 delete "outwardly" insert --slopes toward--.

Signed and Sealed this

*Eighteenth* Day of *June 1985*

[SEAL]

*Attest:*

DONALD J. QUIGG

*Attesting Officer* *Acting Commissioner of Patents and Trademarks*